United States Patent [19]

Dozier

[11] 4,130,336

[45] Dec. 19, 1978

[54] BINDING POST TERMINAL

[75] Inventor: Hilliard Dozier, Morrow, Ohio

[73] Assignee: U.S. Terminals, Inc., Cincinnati, Ohio

[21] Appl. No.: 808,076

[22] Filed: Jun. 20, 1977

[51] Int. Cl.[2] ..... H01R 9/14

[52] U.S. Cl. ..... 339/273 R; 339/105; 339/126 RS

[58] Field of Search ..... 339/17 R, 17 C, 105, 339/126 RS, 273 R, 273 F

[56] References Cited

U.S. PATENT DOCUMENTS

| | | | |
|---|---|---|---|
| 2,857,579 | 10/1958 | Scanlon | 339/105 |
| 3,982,811 | 9/1976 | Siu et al. | 339/105 |

*Primary Examiner*—Joseph H. McGlynn

*Attorney, Agent, or Firm*—Melville, Strasser, Foster & Hoffman

[57] ABSTRACT

A binding post terminal construction wherein the cylindrical body of the post terminates in an inwardly tapered annular shoulder, the end of the post having a conical recess therein, the post being divided into an opposing pair of tines by an arcuate slot, the arcuate slot cutting through the tapered shoulder and the conical recess to define a seat at the upper end of the post for receiving and positioning a straight length of lead wire to be inserted in the slot together with cam surfaces acting to bend the wire to conform to the configuration of the slot as the wire is displaced downwardly into the slot.

7 Claims, 7 Drawing Figures

BINDING POST TERMINAL

This invention relates to electrical terminals and more particularly to binding post terminals of the type wherein one end of the terminal pin is slotted to receive one or more lead wires to form an electrical connection.

BACKGROUND OF THE INVENTION

In the conventional binding post terminal one end of the terminal pin, which is usually cylindrical, is bisected by a slot to provide an opposing pair of tines between which one or more wires to be joined to the terminal are placed, the tines serving as a support for the wires until they have been soldered to each other and to the terminal pin. Conventional binding post terminals are often difficult to use in that the wires, once fitted between the tines of the binding post, are often dislodged before they can be soldered in place, particularly where a number of terminals are being interconnected by a large number of wires in a relatively confined space, such as a miniature circuit board. This has led to the practice of temporarily securing the wires to the terminal pins by either bending the wires relative to the tines or by spot soldering the wires in place. Such temporary connections are made before final soldering of the circuit assembly, the final soldering operation being conducted after all of the parts have been temporarily connected together. The temporary attachment of the wires greatly slows down the assembly procedures and requires a multiplicity of additional hand operations. In addition, the rotational positions of the tines must be considered in assembling the parts on a terminal board or other support since the slots should be aligned with the wires they are to engage. The end result is a substantial additional amount of hand labor which is both time consuming and adds to the cost of the assembly.

It has been proposed to eliminate some of the difficulties inherent in a conventional binding post terminal by providing the terminal with sets of intersecting slots so that the wire is bent as it passes through slots. For example, the end of the terminal pin may be of trifurcated configuration, the terminal pin having three legs or tines defined by three radially oriented slots in communication with each other at the center of the terminal pin. The slotted configuration defines a Y-shaped pattern in which the slots are straight and symmetrically located about the center of the pin, the slots being substantially equaangularly disposed relative to each other. Thus, any two slots define a channel having angularly related legs capable of receiving a wire in bent condition. The purpose of such arrangement is to permit the wires to be fitted within the slots without the use of hand tools, and due to the fact that the wire is bent, a mechanical connection is achieved which is adequate to hold the wire temporarily in place without additional mechanical securing prior to final soldering. It is, however, necessary to prebend the wires so that they will fit into the slots, and this is often difficult to accomplish, particularly in miniature size terminals, due to the tolerances which are involved. Consequently, even though the trifurcated construction was intended to facilitate finger insertion of the wires, it is often difficult to achieve and requires extreme concentration and tedious handwork on the part of the installer.

Another major drawback to the trifurcated terminal design lies in the manufacturing operations required to form the multiple slot configuration. Complicated and expensive milling operations are required, and while various expedients have been tried, including the use of center bored splined stock, there is no inexpensive way to manufacture trifurcated or other multi-slotted terminals.

In contrast to the types of binding post terminals characterized above, the present invention provides an improved binding post terminal having an arcuate slot which is easy to fabricate, the configuration of the binding post being such that the wire may be readily fed through the terminal without pre-bending and the wire automatically bent to the desired curved configuration as an incident of displacing the wire toward the bottom of the slot. The improved terminal construction provides a firm mechanical connection of the wire to the terminal pin, and additionally may be provided with a locking flange for the self-locking of the wire.

SUMMARY OF THE INVENTION

In accordance with the present invention, the terminal pin is provided at one end with a binding post, which is basically of cylindrical configuration, the post having a curved wire receiving slot of uniform width, the opposing walls of the slot being defined by the arcs of concentric circles. For convenience in description, the slot will be characterized as being of arcuate configuration. The arcuate slot divides the post into an outer tine and an inner tine. The outer tine, which is crescent shaped, is substantially longer than the inner tine, which is of essentially semi-cylindrical configuration. Since the wire will be bent around the inner tine as the wire is displaced downwardly in the slot, the inner tine is preferably somewhat thicker than the outer tine so that it will be sufficiently rigid to resist the forces exerted by the wire as it is displaced downwardly in the slot. By making the slot of arcuate configuration, it may be readily cut in the post end of the terminal pin using a hollow end mill. Only a single milling operation is required to form the slot, thereby materially simplifying the fabrication of the terminal pins as well as implementing high speed production.

Another important feature of the invention lies in the configuration of the binding post, the distal end of the post being tapered inwardly to provide a frusto-conical section or tapered shoulder which, when severed by the slot, defines cam surfaces which act, as the wire is displaced downwardly within the slot, to automatically bend the wire around the inner tine.

In order to further implement the camming action which takes place as the wire is displaced downwardly, the distal end of the post is provided with a conical recess which preferably is of the same depth as the frusto-conical portion of the post, the recess also being intersected by the arcuate slot to provide a seat for the wire as well as additional cam surfaces which implement the insertion of the wire into the slot. The recess and the contiguous portions of the slot define an essentially linear seat on which the wire may be placed in general alignment with the arcuate slot, so that upon downward displacement of the wire, it will be caused to follow the cam forming surfaces defined by the intersecting of the slot with the tapered portion of the post, the wire thus being automatically bent to conform to the arcuate configuration of the slot.

In a modification of the invention, the tapered portion of the binding post terminates in an annular flange projecting outwardly beyond the cylindrical portion of the pin, the flange, when severed by the slot, serving as a positive stop to prevent upward movement of the wire once it has been displaced downwardly beyond the flange.

While the insertion of the wires into the arcuate slot may be accomplished by hand, the construction readily lends itself to assembly using a simple insertion tool which engages the wire when laid across the end of the post, the tool having notches which engage and displace the wire downwardly into the slot.

DESCRIPTION OF THE PREFERRED EMBODIMENTS

Figure 1:
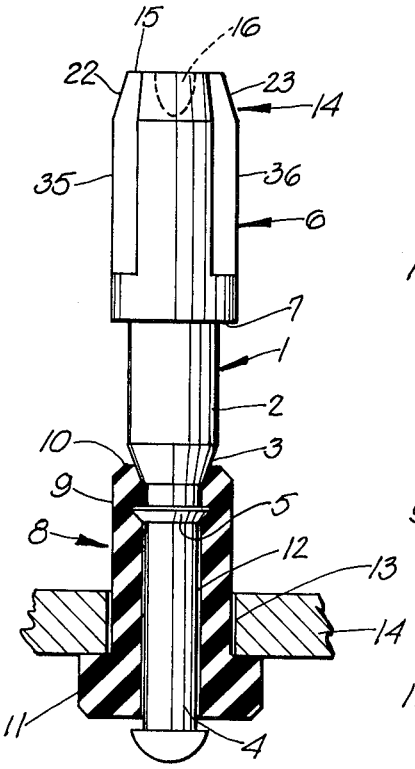
FIG. 1 is a vertical sectional view of a feedthrough type of terminal constructed in accordance with the invention, the terminal being shown inserted in a terminal board prior to locking displacement of the terminal pin.

Referring first to FIG. 1 of the drawings which illustrates a preferred terminal construction embodying the invention, the terminal comprises a terminal pin or electrode 1 formed from conductive metal machined to define an enlarged body part 2, a tapered shoulder 3, and an elongated body part 4 mounting a barbed shoulder 5 near its upper end. At its opposite end, the terminal pin is machined in accordance with the invention to provide a binding post, the cylindrical body of which is indicated at 6, the lowermost surface of the binding post defining an annular shoulder 7 at its juncture with enlarged body part 2.

The terminal illustrated is adapted to be factory assembled with an insulator 8 composed of a relatively hard and yet distortable plastic material, such as tetrafluroethylene, sold under the trademark TEFLON. The insulator has a cylindrical body portion 9 terminating at one end in a beveled edge 10 and at its opposite end in an enlarged head 11. A bore 12 extends lengthwise through the insulator, and during factory assembly the elongated body part 4 of the terminal pin is inserted in the bore 12 to the position illustrated in FIG. 1, the barbed shoulder 5 biting into the insulator so as to retain the parts in their preassembled condition.

Figure 2:
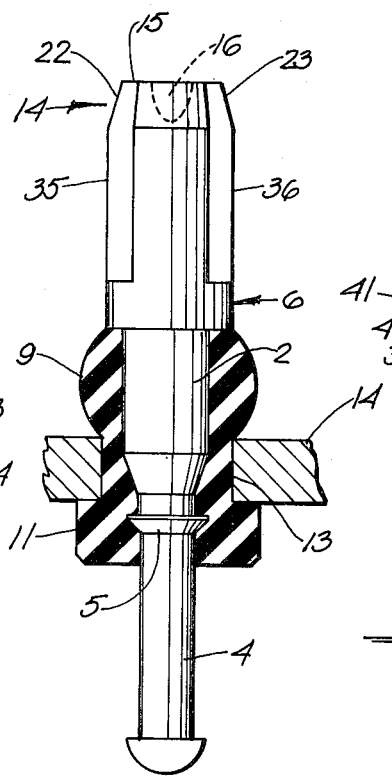
FIG. 2 is a vertical sectional view similar to FIG. 1 illustrating the parts in the locked condition.

In use, the terminal is adapted to be inserted in an opening 13 in a chassis or terminal board 14 with the undersurface of the enlarged head 11 seated against one side of the terminal board in the area immediately surrounding the opening 13. Upon being inserted in the opening, the insulator 8 will be supported from beneath, whereupon the terminal pin 1 will be displaced axially downwardly until the annular shoulder 7 seats against the end edge of the insulator, the parts thereby assuming the position illustrated in FIG. 2 wherein it will be seen that the enlarged body part 2 will have been forced into the bore 12, thereby expanding the cylindrical body portion 9 of the insulator radially outwardly so as to permanently lock the terminal in place by reason of the bulging of the body portion 9 of the insulator immediately beyond the surface of the terminal board.

The terminal assembly and mode of installation thus far described is of known construction, being taught in U.S. Pat. No. 3,095,470, and as such does not constitute a part of the present invntion other than illustrating a preferred terminal construction. It will be understood that other types of terminals may be employed, such for example as press-fitted terminals in which the terminal pin is mounted in an insulator adapted to be received in a chassis opening of a smaller diameter than the diameter of the insulator body. The specific nature of the terminal assembly does not constitute a limitation on the present invention which is directed to the provision of an improved binding post construction usable with terminal pins irrespective of the manner in which they are attached to a terminal board or other support.

Figure 3:
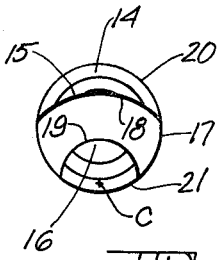
FIG. 3 is a top plan view of the binding post end of the terminal.

In accordance with the invention, the cylindrical binding post 6 terminates at its distal end in an inwardly tapered shoulder 14 having a planar end 15. The end of the post is also provided with a conical recess 16 which preferably has a depth substantially equal to the depth of tapered shoulder 14. An arcuate slot 17 is formed in the binding post, the slot being vertically disposed and preferably extending downwardly approximately three-quarters of the length of the post. As seen in FIG. 3, the outer and inner walls of the slot, indicated at 18 and 19, respectively, are defined by arcs of concentric circles having common center C. The arcuate slot divides the post into an outer tine 20 and an inner tine 21, the former being essentially crescent shape and the latter being of generally semi-cylindrical shape. The arcuate slot may be conveniently milled in the post by means of a hollow end mill having a hollow circular cutting blade, the blade being of a thickness to provide the desired width of the slot. While the recess 16 appears to be parabolic as viewed in FIG. 1, such appearance is due to the intersecting of the conical surface of the recess within the cylindrical surface of inner tine 21 in the area of wall 19.

Figure 4:
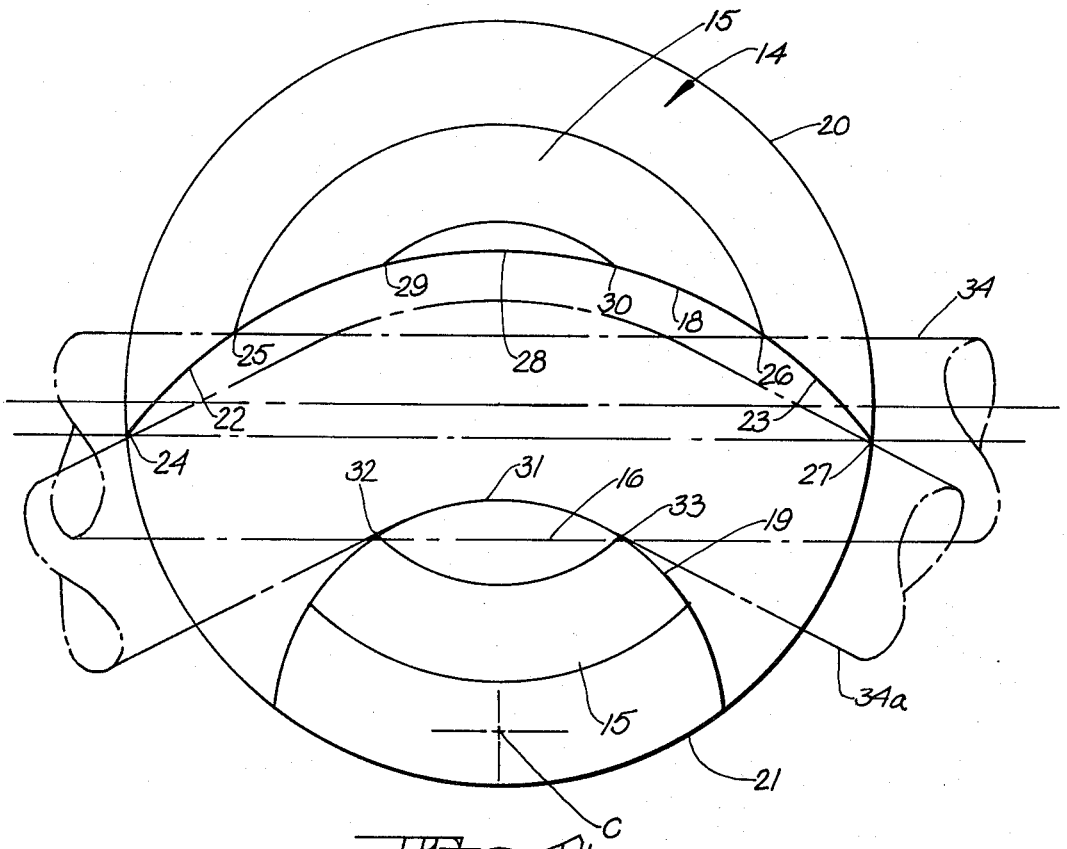
FIG. 4 is an enlarged top plan view similar to FIG. 3 showing in dotted lines the alternate positions of the wire lead.

The portions of the arcuate slot passing through the tapered shoulder 14 and conical recess 16 define a series of cam surfaces or edges which cause the lead wire to be bent as it is moved downwardly within the slot, and the slot and recess also coact to define a wire receiving seat at the uppermost end of the slot on which a straight length of lead wire may be positioned for displacement into the slot. Thus, as seen in FIG. 4, the outer wall surface 18 of the slot defines inclined edges 22 and 23 at its juncture with the outer surfaces of tapered shoulder 14, such edges extending between the points 24, 25 and 26, 27, respectively. Similarly, cam surfaces are defined in outer tine 20 along the curved edge 28 lying between points 29 and 30, and in inner tine 21 along curved edge 31 lying between points 32 and 33, the function of which will now be explained.

Figure 7:
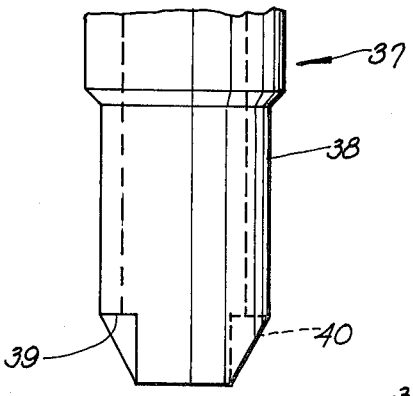
FIG. 7 is a fragmentary side elevational view of a simple tool for inserting the lead wire into the arcuate slot in the binding post.
Figure 7:
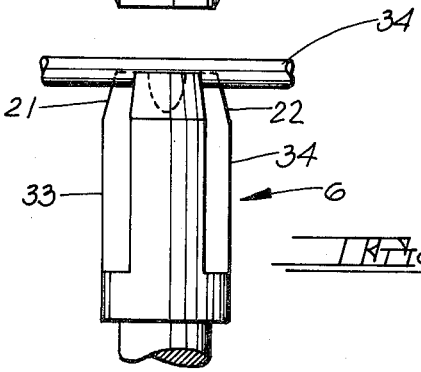

When it is desired to insert a lead wire into arcuate slot 17, an initially straight length of wire, indicated at 34 in FIGS. 4 and 7, is laid across the slot in the manner illustrated, the wire seating against the outer tine 20 at points 25 and 26, and seating against the inner tine 21 at points 32 and 33. In effect, the wire is cradled between the inner and outer tines, as will be evident from FIG.

4. The wire illustrated is of representative diameter for insertion in the slot illustrated, the relative dimensions being such that the wire will be cradled between the tines but will not fall through the slot. When downwardly directed forces are applied to the wire, preferably at points lying outwardly immediately beyond the cylindrical body portion 6 of the binding post, the inclined edges 22 and 23 of outer tine 20 will cause the wire to progressively bend about inner tine 21, the curved edge 31 also cooperates in effecting bending of the wire as it is displaced downwardly. As the wire moves downwardly along the inclined edges 22 and 23, it is progressively bent until it passes beyond points 24 and 27, whereupon the edges 22 and 23 cease their bending function and the wire then moves downwardly along the vertical side edges 35 and 36 of outer tine 20 (seen in FIG. 1) until it seats at the bottom of the slot, the wire thus assuming the position illustrated at 34*a* in FIG. 4. In this connection, the lead wire has been bent to conform to the configuration of the arcuate slot and its natural resiliency causes it to bite against the edges 35 and 36, which are relatively sharp, and hence the wire is firmly held in its bend condition. Of course, if desired, the wire may be bent completely around the wall surface 19 of the inner tine 21, in which event it will have been bent through an angle of substantially 180°.

The insertion of the wire into the slot may be readily accomplished by means of the tool 37 seen in FIG. 7, the tool having a tubular stem 38 of a size to receive the binding post 6 within its hollow interior. The tool has opposing notches, seen at 39 and 40, which are adapted to engage the wire 34 immediately beyond the opposite sides of the binding post. As the tool moves downwardly over the binding post it will displace the wire downwardly causing it to be bent in the manner described.

Figure 5:
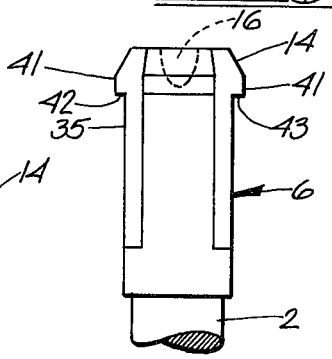
FIG. 5 is a side elevational view of the binding post end of a modified terminal pin construction incorporating an annular locking flange.
Figure 6:
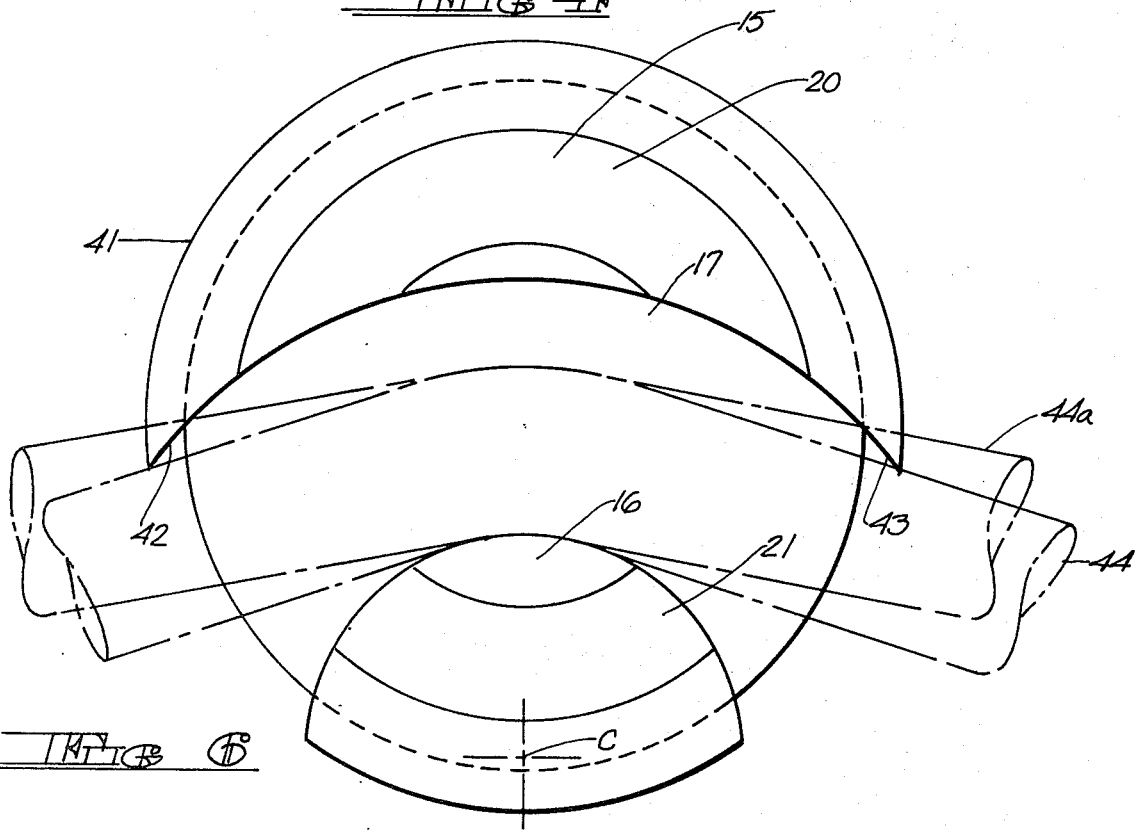
FIG. 6 is an enlarged plan view of the binding post of FIG. 5 illustrating in dotted lines the alternate positions of the lead wire.

In the modification of the invention shown in FIGS. 5 and 6, the tapered shoulder 14 of the binding post terminates at its lower extremity in an annular flange 41 of larger diameter than the underlying cylindrical body portion 6. When the arcuate slot 17 is cut, it also cuts through the annular flange 41, thereby defining locking projections 42 and 43 at the opposite ends of outer tine 20. Thus, as the lead wire 44 shown in FIG. 6 passes downwardly beyond the outermost edges of the projections 42 and 43, its inherent resiliency will cause it to spring back to the position illustrated at 44*a* in FIG. 6, in which position the wire abuts against the vertical side edges 35 and 36 of the cylindrical body portion of the post. The projections thus form stops to prevent upward movement of the wire unless it is flexed sufficiently about inner tine 21 to permit the wire to clear the porjections 42 and 43.

As should now be apparent, the instant invention provides an improved binding post construction in which the combination of an arcuate slot, a tapered shoulder and a conical recess coact to provide a construction wherein a straight lead wire may be laid across the top of the slot and displaced downwardly, downward displacement of the lead wire causing it to conform to the arcuate configuration of the slot, thereby maintaining the wire securely in the slot until it can be permanently soldered. The configuration of the binding post is such that it can be easily and inexpensively fabricated. Insertion of one or more lead wires into the binding post can be readily accomplished by hand or by the use of a simple tool.

It is to be understood that the size and dimensions of the binding post do not constitute limitations on the invention, the principal criteria being that the dimensioning of the parts will be such that a straight length of lead wire may be laid across the top of the slot in such fashion that it will seat between the uppermost inner edges of the opposing tines. Similarly, the configuration of the remainder of the terminal does not constitute a limitation on the invention, and while the illustrated self-locking terminal construction if preferred, the binding post may be incorporated in other types of terminals. Other modifications of the invention will undoubtedly occur to the skilled worker in the art upon reading this specification, and consequently it is not intended that the invention be limited other than in the manner set forth in the claims which follow.

The embodiments of the invention in which an exclusive property or privilege is claimed are defined as follows:

1. In an electric terminal having a conductive terminal pin with a binding post at one end, said binding post comprising a cylindrical body having an inwardly tapered annular shoulder terminating in a planar top, an annular recess extending inwardly from said planar top, a vertically disposed arcuate slot extending downwardly through said tapered shoulder and said recess into said cylindrical body, the inner and outer surfaces of said slot being defined by arcs of a pair of concentric circles having their axes parallel to the longitudinal axis of the binding post.

2. The binding post claimed in claim 1 wherein said tapered annular shoulder terminates at its lowermost end in an annular flange having a larger diameter than the cylindrical body of said binding post, said arcuate slot cutting through said annular flange to define wire engaging projections at the opposite ends of said slot.

3. The binding post terminal claimed in claim 1 wherein said recess is of conical configuration having its longitudinal axis coincident with the longitudinal axis of said cylindrical body.

4. The binding post claimed in claim 3 wherein the depth of said conical recess is substantially equal to the length of said tapered annular shoulder.

5. The binding post claimed in claim 4 wherein the length of said tapered annular shoulder is less than one-half the length of said binding post.

6. The binding post claimed in claim 1 wherein said annular recess is concentric with the longitudinal axis of said cylindrical body and wherein the maximum diameter of said recess is greater than the width of said arcuate slot.

7. The binding post claimed in claim 6 wherein said recess is of a conical configuration and its maximum diameter lies at the top of said arcuate slot.

* * * * *